US006298895B1

(12) United States Patent
Schulz et al.

(10) Patent No.: US 6,298,895 B1
(45) Date of Patent: Oct. 9, 2001

(54) DEVICE FOR LOCALLY CONTROLLABLE PREHEATING OF A MATERIAL WEB

(75) Inventors: Jens Schulz, Hamburg; Gerhard Klaassen, Schenefeld, both of (DE)

(73) Assignee: Peters Maschinenfabrik, GmbH, Hamburg (DE)

( * ) Notice: Subject to any disclaimer, the term of this patent is extended or adjusted under 35 U.S.C. 154(b) by 0 days.

(21) Appl. No.: 09/309,223

(22) Filed: May 10, 1999

(30) Foreign Application Priority Data

May 12, 1998 (DE) ..... 198 21 222

(51) Int. Cl.[7] ..... B31F 1/36
(52) U.S. Cl. ..... 156/470; 156/499
(58) Field of Search ..... 34/422, 624, 664, 34/665; 156/462, 470, 471, 472, 205, 210, 499; 425/DIG. 39, DIG. 245; 165/89, DIG. 464, DIG. 467, DIG. 106, 100, 101, 102, 103; 29/890.039, 895; 100/333, 334, 335, 336, 329

(56) References Cited

U.S. PATENT DOCUMENTS 2,932,091 * 4/1960 Day ..... 34/124
3,182,587 * 5/1965 Woodhall ..... 425/143
4,556,444 12/1985 Schommler .
5,156,714 * 10/1992 Thomas ..... 156/472

FOREIGN PATENT DOCUMENTS 44 16 645 5/1994 (DE) .
0 574 872 B1 5/1996 (EP) .
944 436 4/1946 (FR) .
WO 87 05062 8/1987 (WO) .

* cited by examiner

*Primary Examiner*—Michael W. Ball
*Assistant Examiner*—Gladys Piazza
(74) *Attorney, Agent, or Firm*—Allen N. Friedman; McCarter & English LLP.

(57) ABSTRACT

The invention relates to a preheating device for locally controllable preheating of a material web (12) comprising at least one smooth web and/or at least one corrugated web and moving in feed direction (A), before any adhesive is applied to the material web (12) and before the web (12) is glued to at least one other material web to form a corrugated cardboard web. The device comprises a preheating element (14) adapted to be fed with heat transfer fluid and which is in contact with the material web (12) at a contact surface (17) extending across the entire width (b) of the material web (12). The preheating element (14) comprises a plurality of adjacent preheating sections (50, 50', 50", 50'") arrayed across the width of the material web (12) and each extending the length of the contact surface (17), each of which sections can be separately fed with heat transfer fluid, preferably steam.

17 Claims, 3 Drawing Sheets

DEVICE FOR LOCALLY CONTROLLABLE PREHEATING OF A MATERIAL WEB

RELATED APPLICATIONS

This application claims priority from German Application No. 198 21 222.4, filed May 12, 1998

GOVERNMENT FUNDED RESEARCH

Not applicable

BACKGROUND OF THE INVENTION

1. Field of the Invention

The invention is in the field of corrugated cardboard fabrication.

2. Brief Description of the Background Art

The invention relates to a preheating device for locally controllable preheating of a material web comprising at least one smooth web and/or at least one corrugated web and moving in one direction, before any adhesive is applied to the material web and before the web is glued to at least one other material web to form a corrugated cardboard web. The device comprises a preheating element that is adapted to be fed with heat transfer fluid and that is in contact with the material web at a contact surface extending across the entire width of the material web.

A problem that frequently arises in practice is that the material web has "wet strips", or a moisture distribution varying across its width. These wet strips result in uneven drying of the adhesive during the gluing of the material webs, which results in warping of the corrugated board and hence poor quality corrugated board products. More intensive or less intensive heating varying across the material web width corresponding to the respective moisture content would enable any moisture differences of this kind in the web of material to be compensated before the application of adhesive or before gluing.

For example, the article "Widmer-Walty installs infra-red drying systems in their corrugator" by Michael Brunton, published in the journal "International Paperboard Industry", issue of September 1994, describes an arrangement in which, in addition to uniform contact heating by a preheating cylinder fed with steam, the web of material can be irradiated by means of an array of individually controllable infrared lamps placed across the entire width of the web of material. However, locally selective preheating by means of an infrared lamp arrangement has considerable disadvantages. For example, additional space is required for installation of the infrared radiation unit inside the preheating device and hence inside the corrugated cardboard machine. There is also a risk that the material web may ignite if the infrared radiation is too intense. As a safety measure it is therefore necessary, as described in the article, to install an additional sprinkler installation in order to extinguish any ignited material web portions. This further increases the cost of the equipment and requires increased space for the installation of the preheating device. Obviously such a preheating device is expensive both to purchase and maintain, particularly because of the safety precautions and the high power required for the infrared lamps.

In addition to uniform preheating by means of a steam-fed preheating cylinder, locally selective preheating over the width of the material web by microwave radiation or by inductive heat generation is known in the industry. Reference should be made, for example, to the text of the Paper "Temperaturkontrolle an der Wellpappenanlage" by E Bradatsch, BHS Corrugated, Germany, of the 9th Technischer Seminar der FEFCO (Apr. 22–25 1997, Nice, France).

In addition, DE 34 00 333 C2 discloses a drying device in which, after gluing, the joined corrugated web can be supplied with locally variable heat by means of spaced-apart, separately controllable plate elements for the purpose of evenly drying the adhesive.

SUMMARY OF THE INVENTION

It is the object of this invention to provide a preheating device of the type indicated above, that allows locally controllable preheating with reduced space requirements and with reduced need for additional safety precautions.

To this end, this problem is solved by a preheating device as stated above, wherein the preheating element comprises a plurality of adjacent preheating sections arranged across the material web, each of which can be separately fed with heat transfer fluid, preferably steam. By subdividing the preheating element into a plurality of preheating sections, which can be separately fed with heat transfer fluid, any desired portions of the width of the material web can be heated more intensively than the rest of the web. As a result, the wet strips referred to above can be dried more intensively than adjoining sections that are not as wet. Thus, it is possible to obtain a relatively uniform moisture distribution across the entire width of the material web, this being achieved before any adhesive application and before the gluing of the material webs. Ultimately this results in more uniform drying of the adhesive over the width of the material web, so that warping of the corrugated cardboard web is largely prevented and the quality of the corrugated cardboard product is improved. In accordance with the foregoing, according to the invention the locally dispersed preheating of the material web can be effected solely by means of the device that can be fed with heat transfer fluid. There is no need to provide additional preheating devices, so that the preheating device according to the invention is advantageous because of reduced space requirements.

BRIEF DESCRIPTION OF THE DRAWINGS

The invention is explained in detail hereinafter with reference to some exemplified embodiments and the accompanying drawings wherein.

DETAILED DESCRIPTION OF THE INVENTION

Figure 1:
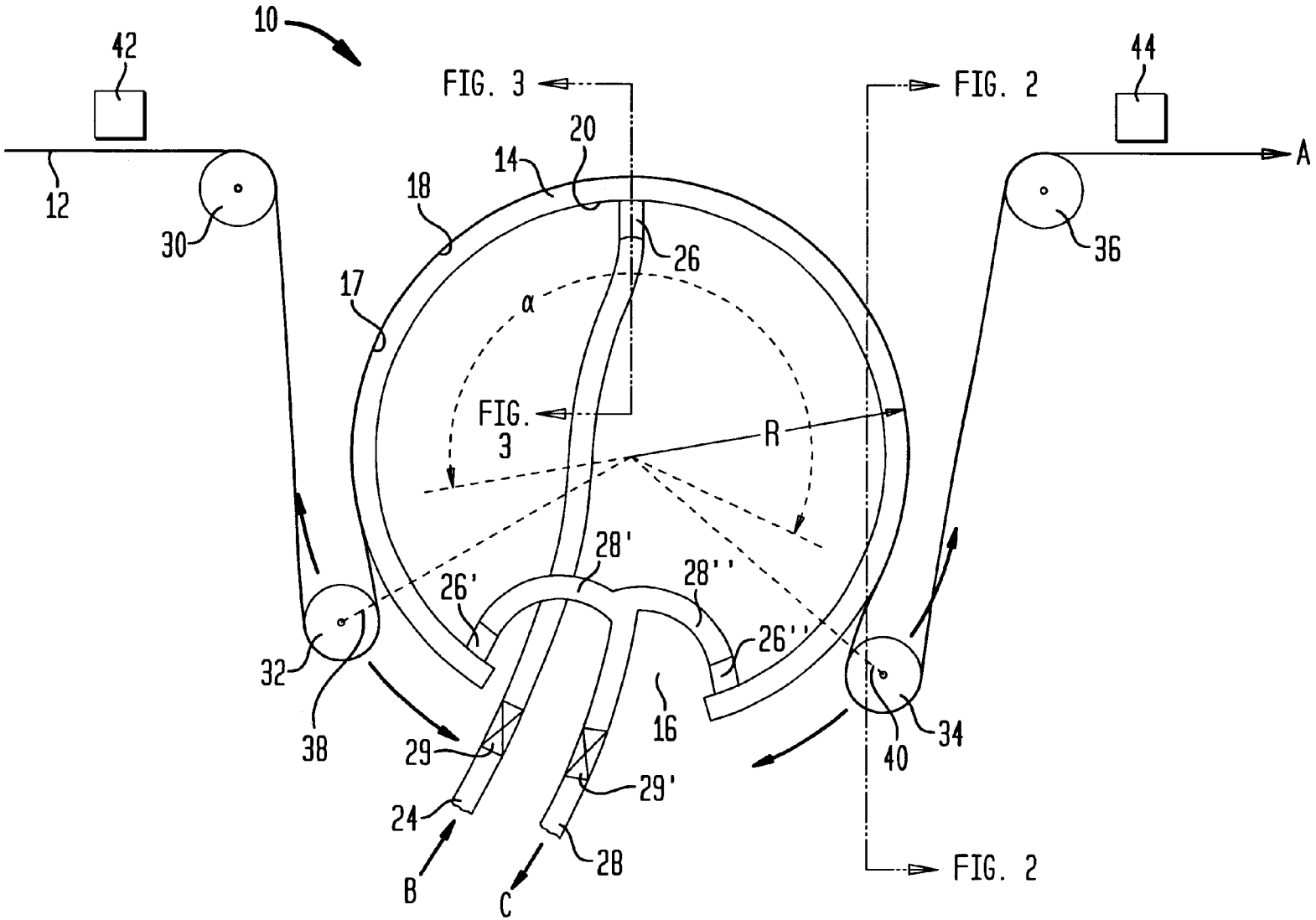
FIG. 1 is a schematic side elevation of a preheating device according to the invention.

The preheating device according to the invention has the further advantage that the entire heat supply to the web material in the preheating device is effected by contact heating similar to conventional preheating devices that do not employ locally varying preheating. This very efficient type of heat transfer reduces the amount of energy required and hence the risk of material web ignition due to excessive heating. Consequently no additional safety precautions, such as a sprinkler installation, are needed.

To obtain the largest possible contact surface for heat transfer to the material web, while reducing space requirements, and guarantying continuous contact between the material web and the preheating element, the contact surface of the preheating element is convexly curved, preferably in the form of an arc of a circle. The radius of curvature may have a value of from approximately 200 mm 600 mm, preferably approximately 500 mm. For example, the contact surface may have the shape of a closed circular cylinder. Alternatively, the preheating element may have an open configuration outside the material web contact zone, i.e. a horseshoe-shaped cross-section, for example.

The preheating sections of the preheating element can be constructed in various ways. For example the interior of the preheating element could be subdivided into a plurality of compartments by partitions extending across the material web. According to a proposal of the invention, however, the preheating element comprises, in addition to a contact plate comprising the contact surface, a cover plate disposed on that side of the contact plate that is remote from the material web and at a short distance therefrom, the contact plate and the cover plate together enclosing a plurality of cavities that can be fed with the heat transfer fluid. The result is a preheating element with a low preheating volume. Preferably, the total volume of the preheating sections is less than 100 liters, preferably less than 50 liters, and still more preferably less than 20 liters. A low total volume of this kind has the advantage that considerably smaller quantities of heat transfer fluid are required to preheat the respective web of material, thus reducing the plant operating costs. In addition, a preheating device of this kind, due to its low overall volume, is no longer subject to relevant regulations for steam-fed boilers (e.g. the TUV or ASME regulations) which are applicable to steam-fed equipment with total volumes of 200 liters or more. Thus, it is much simpler to operate a preheating device of this kind. Given a radius of-curvature of 200 mm the total volume of the preheating sections is about 5.5 liters, whereas it is approximatelyl 17 liters with a radius of curvature of 600 mm.

An alternate embodiment that has the advantage of simpler construction employs a single, unbroken contact plate and a cover plate. In this embodiment a plurality of fluid hoses or fluid hose systems are placed on that side of the contact plate remote from the material web. Each preheating section can have just one or a plurality of cavities separated from one another and jointly fed with heat transfer fluid.

The contact plate and the cover plate can be made of various materials. It is possible to make them from plastic or plastic-coated plates. Preferably, however, the contact plate and/or the cover plate is/are made of metal, preferably stainless steel. This guarantees particularly easily maintained preheating equipment with good thermal conductivity properties.

To ensure good dimensional stability of the contact surface, the wall thickness of the contact plate is between 3 mm and 15 mm, preferably about 5 mm. Since the cover plate serves only to define the cavities, its wall thickness can be much smaller, it being proposed that the wall thickness of the cover plate should be between 1 mm and 5 mm, preferably about 1.5 mm. Wall thicknesses in this range also allow relatively "reaction-fast" thermal control of the contact plate since the quantity of material to be heated can be kept small.

To mount the cover plate to the contact plate it is proposed that the contact plate and the cover plate should be interconnected to form the cavities by means of sealingly separated connecting seams. For example, these connecting seams can be easily fabricated compression welded seams. However, other types of seam such as adhesive seams, are also possible.

In order to improve the stability and rigidity of the preheating element, the contact plate and the cover plate should be interconnected between the connecting seams preferably at regularly distributed connecting points. This produces an arch-shaped construction of the cavity of the cover plate between the connecting seams and/or the connecting points. Such a connection of the contact plate and the cover plate also allows very simple production of the cavity, as described below.

Firstly, a substantially flat cover plate is placed on the contact plate, in its substantially flat state. The contact plate and the cover plate are then connected at the connecting seams and, if required, at the connecting points. In the case of a metal contact plate and cover plate, the connection can preferably be made by compression welding or spot welding. The connected contact plate and cover plate arrangement is then brought into the required convex shape, for example by rolling or a similar forming process. Finally, a hydraulic fluid, preferably water, is forced under high pressure between the contacting plates by means of suitable supply and discharge tubes, which will be discussed in greater detail below. Because of the cover plate's thinner construction, relative to the contact plate, the high pressure of the hydraulic fluid results in bulge-like plastic deformations of the cover plate, so that a continuous arched cavity forms between the connecting seams and/or the connecting points. Suitable support for the contact plate can prevent the latter from also undergoing plastic deformation.

As already stated above, a preheating element constructed in this way has the further advantage over a preheating cylinder in the form of a boiler in accordance with the prior art that the total volume formed by all the preheating sections or their cavities and fed with heat transfer fluid is considerably smaller than the interior of the preheating cylinder in the form of a boiler.

To supply the preheating sections with fluid it is proposed that at least one feed tube for supplying heat transfer fluid and at least one discharge tube for discharging heat transfer fluid should be associated with each preheating section. This allows a separate and independent feed of heat transfer fluid to the individual preheating sections.

To permit simple construction of the preheating device, according to the invention, the preheating element is placed in a fixed position. This does away with the need for a special mounting as is required with rotatable preheating cylinders and this facilitates the connection of the individual preheating sections through the feed tubes since there are no interfaces requiring sealing between relatively non-rotating bearing parts and rotating preheating element parts. Non-rotating preheating devices are known per se (EP 0 574 872 B1).

In an arrangement of this kind, which is fixed with respect to its direct surroundings, at least one discharge tube is placed at the absolutely or relatively lowest region of each preheating section. The reason for this lies in the thermodynamic processes taking place in the preheating sections. If, for example, as is preferred, steam is supplied as the heat transfer fluid through the feed tubes, the steam flows inside the cavity of a preheating section from the feed tube towards a discharge tube and gives up heat to the material web through the contact plate. As a result of this heat delivery, at least some of the steam condenses and the resulting condensate flows along the cavity walls to the point which, locally, is absolutely or relatively the lowest point. To return the condensate to a fluid circuit, by suction if necessary, at least one discharge tube must, therefore, be provided in the lowest position in each preheating section.

If, for example, we consider a preheating element that is fixed and is constructed as a closed circular cylinder in which the feed tube of a preheating section is placed at the highest position, the condensate gathers at the lowest position so that just one discharge tube is sufficient to discharge the condensate. If, on the other hand, we consider a preheating element formed as a shell curved in the form of an arc of a circle and open downward (a horseshoe shape), when steam is supplied the condensate collects in the two separate lowest preheating element sections (the ends of the horseshoe arms), so that a discharge tube must be placed at each of these sections in order to discharge the condensate.

To allow simple connection of the fluid supply and discharge tube to the preheating device, the feed tubes and the discharge tubes are respectively adapted to be connected to the cavity by means of pipe fittings mounted on the cover plate. In the case of a metal cover plate, these pipe fittings can be welded directly to the plate.

To feed the preheating sections with heat transfer fluid, it is proposed that they should be adapted to be supplied with heat transfer fluid from a common fluid system, a valve system being associated with each preheating section to control the quantity of heat transfer fluid fed to it it per unit of time. The valve system can be used to control the flow of heat transfer fluid through each connected preheating section, permitting the flow through each of the preheating sections to be individually controlled. Alternatively, the individual preheating sections can be fed with heat transfer fluid at different temperatures.

It is possible to guide the material web over constant length region of the contact surface by wrapping the material web around the preheating element over a constant angle. However, one can vary the supply of heat to the material web by varying the length of the contact zone, for example by varying the wrapping angle of the material web around the preheating element. To accomplish this it is proposed to associate at least one web guide element with the preheating element, the guide element being adjustable relatively to the preheating element.

In the case of variable web speeds, it is advantageous to make the position of the at least one web guide element adjustable according to the web speed.

Additionally or alternatively thereto, according to the invention, sensor means for detecting the moisture content and/or temperature of the material web are provided across the material web at the web entry and/or at the web exit. The position of at least one web guide element, the direction of motion and/or the supply of heat transfer fluid to the preheating sections are controllable according to the detected moisture and/or temperature. Using such sensors it is possible to detect temperature and moisture profiles across the width of the material web upstream and, if required, downstream of the preheating device, and then control the locally variable preheating within a control loop on the basis of the detected moisture or temperature profiles. It is possible for both the wrapping angle of the material web around the preheating element and the flow of heat transfer fluid through the individual preheating sections to be used as control variables.

FIG. 1 shows a preheating device according to the invention having the general reference 10 and intended for the locally controllable preheating of a material web 12 moving in the direction A. The material web 12 may be a smooth web or a composite web consisting of at least one corrugated web and at least one smooth web. The preheating device 10 comprises a preheating element 14 which is convexly curved in the form of an arc of a circle with a radius of curvature R and is open at the bottom 16 to give a substantially horseshoe shape.

The preheating element 14 comprises a contact plate 18 partially in contact with the material web 12 at a single, unbroken contact surface 17, and a cover plate 20 connected to said contact plate 18 in the manner explained in detail hereinafter. Cavities 22, formed between the contact plate 18 and the cover plate 20 and, as will be seen from FIG. 2 and explained in detail hereinafter, can be fed with heat transfer fluid in the direction of arrow B through a fluid feed tube 24. The latter is connected to a pipe fitting 26 on the preheating element 14. The heat transfer fluid, preferably steam, flows through the cavities 22 in the direction of the discharge tubes 28', 28" and is discharged finally through a common main discharge tube 28 in the direction of arrow C through pipe fitting 26', 26" provided on the cover plate 20 and branch discharge tubes 28', 28" connected thereto. The fluid supply and discharge to and from each cavity 22 is controllable though proportional valves 29, 29' which, if required, have a pressure regulating function in order to maintain a predetermined pressure inside the corresponding cavity 22.

The material web 12 is guided to the contact plate 18 by means of a roller-shaped stationarily positioned web guide element 30 on the entry side and a variable- position web guide element 32 on the exit side, and is guided to the next treatment station, e.g. a gluing machine (not shown) oil the material web exit side by means of a variable-position web guide element 34 on the exit side and a stationary web guide element 36 on the exit side. The web guide elements 30, 32, 34, 36 are preferably rotatable about an axis of rotation extending perpendicular to the drawing plane.

The variable-position web guide element 32 on the entry side and the variable-position web guide element 34 on the exit side, as shown diagrammatically in FIG. 1, are pivoted by means of pivoting arms 38 and 40 around the preheating element 14, i.e. around the outer contour of the contact plate 18, so that, depending upon the position to which the pivoting arms 38 and 40 are pivoted, a specific wrapping angle alpha ($\alpha$) is obtained (see FIG. 1—broken-line dimensioning arc), by which the material web 12 wraps around the contact plate 18 of the preheating element 14. Thus, by varying the position of the pivoting arms 38, 40, i.e. by varying the wrapping angle alpha, it is possible to change the magnitude of the contact zone between the material web 12 and the contact plate 18. The possibility of changing the position of the variable-position web guide elements 32 and 34 is indicated by arcuate arrows in FIG. 1.

Figure 2:
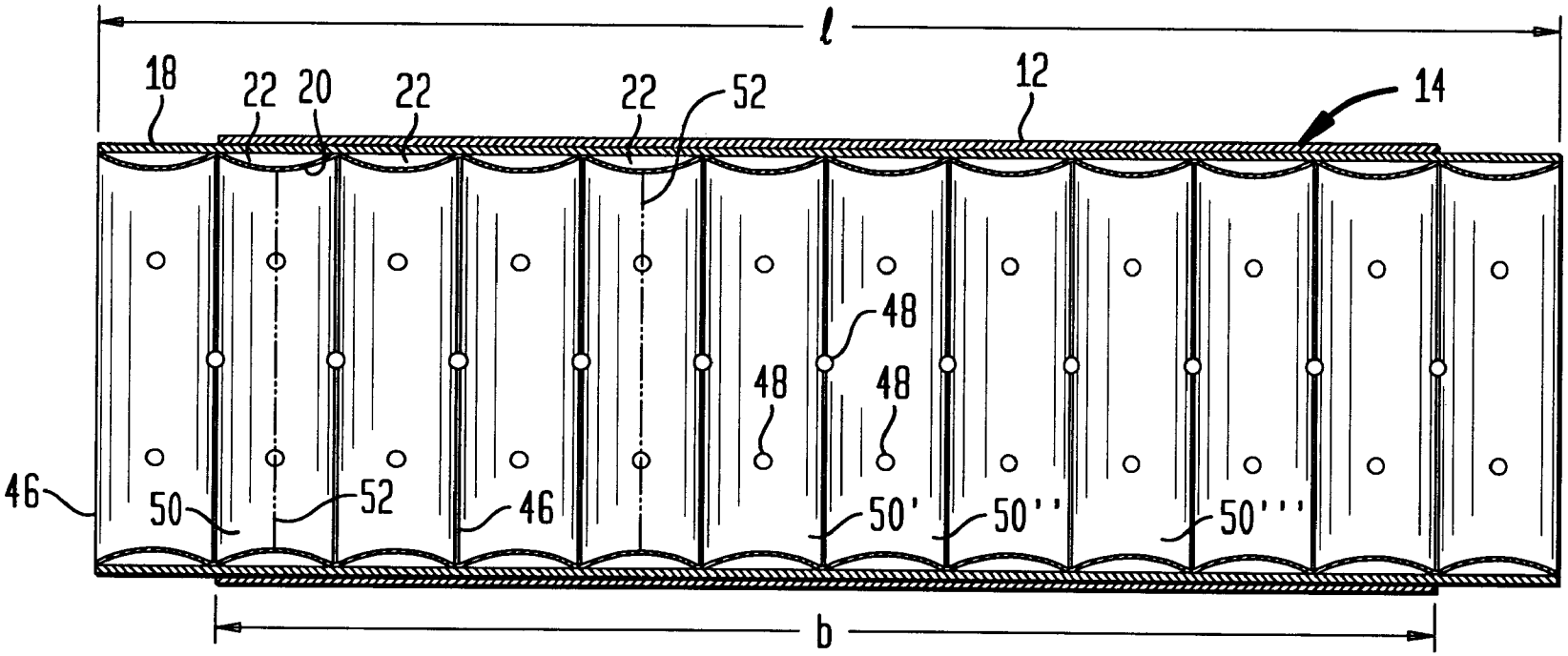
FIG. 2 is a sectional view of the preheating element according to the invention on the line II—II in FIG. 1

Sensor elements 42, 44 are also provided on the preheating device 10 distributed across the width of the material web 12 on the web entry side and the web exit side, enabling the moisture content and the temperature of the material web 12 to be detected over its entire width b (see FIG. 2).

The construction of the preheating element 14 as outlined above will now be discussed in detail below with reference to FIG. 2. As already stated, the preheating element 14 comprises the contact plate 18 and the cover plate 20 connected thereto. The connection between the contact plate 18 and the cover plate 20 is effected on the one hand by means of sealing connecting seams 46 and on the other hand by connecting points 48 placed between these seams. The individual connecting seams 46 subdivide the preheating element 14 into adjoining preheating sections 50, 50', 50", 50'", each of which can be separately fed with heat transfer fluid, as explained above. The individual preheating sections 50, 50', 50", 50'" each comprise a continuous cavity 22 enclosed between the contact plate 18 and the cover plate 20 and formed as an arch as a result of the connection of the contact plate 18 and the cover plate 20 by the connecting seams 46 and the spot welds 48. In the construction shown in FIG. 2, a continuous cavity 22 is associated with each preheating section 50 and is in each case separately fed with heat transfer fluid.

However, it would also be possible to provide inside a preheating section 50 another connecting seam 52 shown in broken lines in FIG. 2 to subdivide the preheating section 50 again into two sealingly separated cavities, which are then fed in parallel, however, in the same way (i.e. with the same amount of fluid per unit of time at the same fluid temperature).

It will also be seen from FIG. 2 that the width b of the material web 12 is shorter than the length 1 of the preheating element 18. The direction of flow of heat transfer fluid is shown by arrow E.

Figure 3:
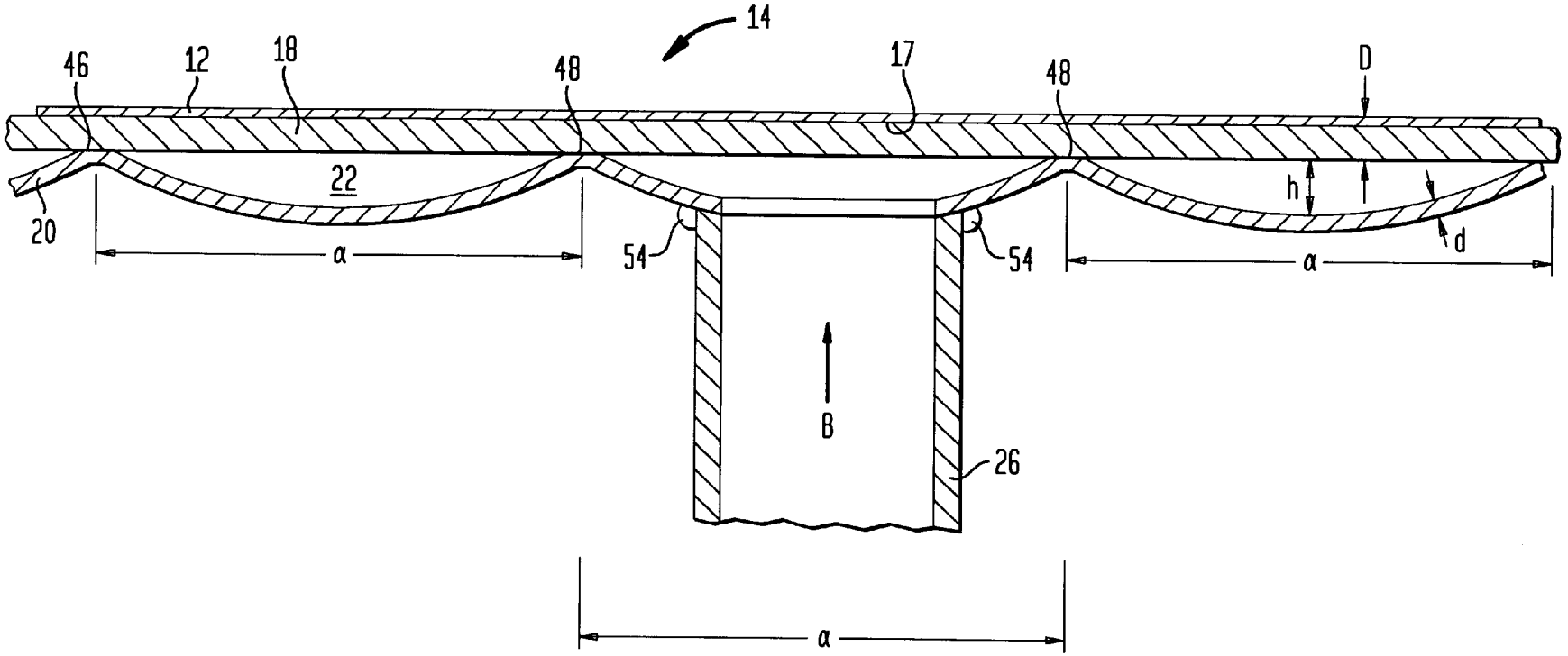
FIG. 3 is a sectional view of the preheating element according to the invention on the line III—III in FIG. 1.

FIG. 3 shows an enlarged sectional detail along the line III—III of FIG. 1. In this illustration, the material web 12 for preheating is in the form of a smooth web shown in contact with the contact surface 17 of the contact plate 18, the cover plate being shown with its arched structure on that side of the contact plate 18 remote from the contact surface 17. The cover plate 20 and the contact plate 18 are each connected at the connecting points 48 and the connecting seam 46.

As will be seen from the dimensioning arrows, the connecting points 48 are spaced from one another and from the connecting seams 46 at regular intervals a.

FIG. 3 also shows the pipe fitting 26 welded to the cover plate 20 in the area between individual connecting points 48 by means of weld seams 54 and through which heat transfer fluid can be fed to the cavity 22 in the direction of arrow B. It is also possible to place the pipe fitting 26, i.e. fix it to the cover plate 20, centrally at the location of a connecting point 48.

FIG. 3 also shows the relationship between the thickness D of the contact plate 18, the thickness d of the cover plate 20, and the height h of the bulge-like arching of the gap 22. With regard to the production by means of the hydraulic expansion method described above in the introduction to the description, it is advantageous, as already stated, if the thickness D of the contact plate 18 is equal to at least twice the thickness d of the cover plate 20. For adequate heat transfer from the heat transfer fluid to the contact plate 18 it is also advantageous if the height h is at least 2 mm. This figure for the height h should be regarded solely as a rough guide and can of course vary considerably depending on the materials used for the contact plate 18 and the cover plate 20 and according to the thermal properties of the heat transfer fluid.

The following should be noted regarding operation of the preheating device. The material web 12 is guided in the direction A by means of the fixed and variable-position web guide element 30, 32, 34, 36 and over the preheating element 14, heat being transferred to the web in its contact area with the preheating element 14, or more accurately with the contact surface 17 of the contact plate 18. The sensor elements 42 and 44 respectively detect the moisture content and temperature of the material web over the entire width b on the material web entry side and the material web exit side, so that it is possible to detect variations of these values across the material web width b. In order to compensate for such variations, particularly moisture variations ("wet strips"), the individual preheating sections 50, 50', 50", 50'" are fed with heat transfer fluid differentially according to the moisture profile detected by the sensor elements 42, 44, i.e. different quantities of fluid are fed per unit of time to the individual preheating sections 50, 50', 50", 50'" and discharged therefrom, so that more intensive heating and hence more intensive moisture expulsion (evaporation) can be obtained in very damp regions of the material web. By means of the sensor element 44 it is possible to detect the preheating result, particularly the result of the differential control of the individual preheating sections 50, 50', 50", 50'", so that if the result is unsatisfactory, it is possible to correct the flow to the individual preheating sections 50, 50', 50", 50'" by an appropriate feedback to the fluid valving system. The preheating is therefore effected by means of a closed-loop control.

It should be noted that depending on the material web width b the preheating element 14 can be subdivided into fewer than or more than four preheating sections, as shown in FIG. 2.

What is claimed is:

1. In a corrugating apparatus, a preheating device for locally controllable preheating of a material web (12) comprising a preheating element (14) adapted to be fed with heat transfer fluid consisting of steam, the device being in contact with the material web (12) at a contact surface (17) extending across the entire width (b) of the material web, wherein the preheating element (14) comprises a plurality of adjacent preheating sections (50, 50', 50", 50'") arrayed across the material web (12) and each extending the length of the contact surface (17), each of which adapted to being separately fed with the heat transfer fluid which said contact surface (17) is single and unbroken across the entire width (b) of the material web (12).

2. A preheating device of claim 1 wherein the contact surface (17) of the preheating element (14) is convexly curved, in the form of an arc of a circle of radius, R.

3. A preheating device according to claim 2, wherein the radius, R, is from approximately 400 mm to approximately 600 mm.

4. A preheating device of claim 3 wherein the radius of curvature R is approximately 500 mm.

5. A preheating device of claim 1 wherein the preheating element (14) comprises a contact plate (18) made of metal with a contact surface (17), and a cover plate (20) situated on that side of the contact plate (18) remote from the material web (12), the contact plate (18) and the cover plate (20) together enclosing a plurality of cavities (22) adapted to being fed with the heat transfer fluid.

6. A preheating device of claim 5 wherein the wall thickness of the contact plate (18) is from 3 mm to 15 mm.

7. A preheating device of claim 6 wherein the wall thickness of the contact plate (18) is approximately 5 mm.

8. A preheating device of claim 6 wherein the wall thickness of the cover plate (20) is from 1 mm to 5 mm.

9. A preheating device of claim 7 wherein the wall thickness of the cover plate is approximately 1.5 mm.

10. A preheating device of claim 5 wherein the contact plate (18) and the cover plate (20) are interconnected by sealingly separating connecting seams (46) to form the cavities (22) and are interconnected between the connecting seams (46) at uniformly distributed connecting points (48), the cavity (22) between the connecting seams (46) and the connecting points (48) being arched.

11. A preheating device of claim 1 wherein the preheating sections (50, 50', 50", 50'") have a total volume less than 100 liters.

12. A preheating device of claim 11 wherein the preheating sections (50, 50', 50", 50'") have a total volume less than 50 liters.

13. A preheating device of claim 12 wherein the preheating sections (50, 50', 50", 50'") have a total volume less than 20 liters.

14. A preheating device of claim 1 wherein at least one discharge tube (28, 28', 28") is placed at an absolutely or relatively lowest position of each preheating section (50, 50', 50", 50'") with respect to its immediate surroundings.

15. A preheating device of claim 5 wherein at least one feed tube (24) and at least one discharge tube (28, 28', 28") are each adapted to be connected to a cavity (22) by pipe fittings (26, 26', 26") situated on the cover plate (20).

16. A preheating device of claim 1 comprising at least one web guide element (32, 34) adjustable relative to the preheating element (14), and adapted for varying a wrapping angle ($\alpha$) of the material web (12) around the preheating element (14) and wherein the position of the at least one adjustable web guide element (32, 34) is adjustable according to the web speed.

17. A preheating device of claim 16 wherein sensor means (42, 44) are provided extending across the material web (12) at the material web's entry or at the material web's exit for the purpose of detecting the moisture content and the temperature of the material web (12), and in which the position of the at least one adjustable web guide element (32, 34) or the supply of heat transfer fluid to the preheating sections (50, 50', 50", 50'") is controllable depending on the detected moisture content or temperature.

* * * * *